US011408283B2

(12) United States Patent
Mancini et al.

(10) Patent No.: US 11,408,283 B2
(45) Date of Patent: Aug. 9, 2022

(54) FORMWORK FOR THE PRODUCTION OF CONCRETE ARTICLES

(71) Applicant: SOINTEK S.R.L., Novate Milanese (IT)

(72) Inventors: Michele Mancini, Rome (IT); Roberto Roberto, Rome (IT)

(73) Assignee: SOINTEK S.R.L., Novate Milanese (IT)

( * ) Notice: Subject to any disclaimer, the term of this patent is extended or adjusted under 35 U.S.C. 154(b) by 0 days.

(21) Appl. No.: 17/254,648

(22) PCT Filed: Jun. 21, 2019

(86) PCT No.: PCT/IB2019/055257
§ 371 (c)(1),
(2) Date: Dec. 21, 2020

(87) PCT Pub. No.: WO2019/244124
PCT Pub. Date: Dec. 26, 2019

(65) Prior Publication Data

US 2021/0148231 A1 May 20, 2021

(30) Foreign Application Priority Data

Jun. 22, 2018 (IT) ..... 102018000006588

(51) Int. Cl.
*E21D 11/10* (2006.01)

(52) U.S. Cl.
CPC ..... *E21D 11/102* (2013.01); *E21D 11/105* (2013.01)

(58) Field of Classification Search
CPC ..... E21D 11/10; E21D 11/18; E21D 11/102; E21D 11/105; E02D 2250/0023; E04G 11/06
See application file for complete search history.

(56) References Cited

U.S. PATENT DOCUMENTS 4,173,421 A * 11/1979 Harhoff ..... E21D 9/0692 405/288
4,334,800 A * 6/1982 Stuckmann ..... E21D 9/0692 405/141
2020/0002957 A1* 1/2020 Mancini ..... E04G 11/065

FOREIGN PATENT DOCUMENTS

DE 1 902 971 8/1970
DE 26 33 430 2/1978
(Continued)

OTHER PUBLICATIONS

International Search Report for PCT/IB2019/055257 dated Sep. 17, 2019, 4 pages.

(Continued)

*Primary Examiner* — Benjamin F Fiorello
(74) *Attorney, Agent, or Firm* — Nixon & Vanderhye

(57) ABSTRACT

A formwork for the production of concrete articles includes: a supporting beam with a development axis; a panel which has an outer surface designed to be in contact with a concrete casting, the panel being connected on an inner side to the beam and being curvable around a transverse direction relative to the development axis of the beam; and a connector, present in the area of one end of the beam, allowing connection of the beam to another structure. The connector includes: a slide connected to the beam to perform a translation or rotation movement, or both, the slide carrying a first fastener connecting the beam to another adjacent beam, and a second fastener connecting the beam to a supporting structure; and an adjustment mechanism which acts on the slide to move it continuously between a retracted position and an extended position, adjusting its position relative to the beam.

20 Claims, 5 Drawing Sheets

(56) References Cited

FOREIGN PATENT DOCUMENTS

| | | | | |
|---|---|---|---|---|
| DE | 38 41 579 | | 6/1990 | |
| DE | 10 2007 034 432 | | 1/2009 | |
| EP | 1 096 105 | | 5/2001 | |
| EP | 2 472 057 | | 7/2012 | |
| EP | 3168413 | B1 * | 4/2019 | ..... E21D 11/102 |
| EP | 3543459 | A1 * | 9/2019 | ..... E21D 11/10 |
| SU | 1567781 | | 5/1990 | |
| WO | 2014/141083 | | 9/2014 | |
| WO | 2014/180841 | | 11/2014 | |

OTHER PUBLICATIONS

Written Opinion of the ISA for PCT/IB2019/055257 dated Sep. 17, 2019, 6 pages.

* cited by examiner

FORMWORK FOR THE PRODUCTION OF CONCRETE ARTICLES

CROSS-REFERENCE TO RELATED APPLICATIONS

This application is the U.S. national phase of International Application No. PCT/IB2019/055257 filed Jun. 21, 2019 which designated the U.S. and claims priority to IT 102018000006588 filed Jun. 22, 2018, the entire contents of each of which are hereby incorporated by reference.

BACKGROUND OF THE INVENTION

Field of the Invention

The present invention concerns a formwork for the production of concrete articles and in particular articles with a curved profile such as, for example, coverings of tunnels or similar.

In greater detail, the invention concerns a formwork of the type configured to vary the curvature of at least one surface of said articles.

Description of the Related Art

In the construction sector, in particular in the construction of infrastructures and buildings, formworks are used for the production of concrete articles in which the concrete is cast in the fluid state to give it the desired form once it has solidified.

Said formworks, especially those used to construct large infrastructures such as tunnels, bridges or similar, generally comprise at least one rigid structural element which supports a containment panel, or sheet, called "shell".

The shell is the part of the formwork directly in contact with the concrete casting and it therefore determines the geometric form of the surface, or surfaces, of the article in contact with it.

The structural element, on the other hand, has the job of transferring the forces discharged by the casting onto the shell to a supporting framework. In formworks for the production of curved surfaces, the structural element can also have the job of determining and maintaining the curvature of the panel that constitutes the shell.

For the construction of tunnels, or other similar works, in general a plurality of formworks are provided, connected to one another and arranged adjacent in a transverse direction to that of the tunnel, so that the various panels form a continuous curved surface, which extends for a part of or for all the perimeter of the lateral wall of said tunnel.

According to a known embodiment of said formworks, the panels that constitute the shell each have a given profile or fixed curvature.

In general, the curvature of the panel, typically a metal sheet, is determined by an intermediate rigid element interposed between the structural element and the panel, or directly by said structural element.

Said intermediate rigid element, when provided, can comprise a board, arranged parallel to the structural element, with a curved outer edge on which the inner surface of the panel rests, or a plurality of struts, each having a given length according to the required curvature of the panel.

Formworks produced in this way are described for example in EP 1096105 A2, EP 2472057 A2, WO 2014141083 A2 and WO 2014180841 A2.

Said known formworks, or at least some parts of them, therefore have to be purposely constructed according to the specifications of a given work (tunnel) to be constructed, involving an increase in both costs, since they cannot be re-used, or only re-used for identical tunnels, and timescales, since all the formworks have to be arranged before commencing the concrete casting operations.

In the sector, universal formworks are also known, namely configured so as to vary the curvature of the panel to adapt to tunnel profiles with different specifications.

In general, in said formworks with variable curvature, the panel is connected to the supporting element, typically a beam, by means of an adjustable mechanism which allows the panel to be bent to varying degrees to obtain the desired curvature.

Examples of said formworks with variable curvature are described in DE 1902971 A1, EP 2472057 A2 and DE 3841579.

To obtain a wall of the article with a uniform curvature and without interruptions, the adjacent formworks must be arranged so that the lateral edges of the panels are in contact with one another and the beams are correctly spaced and angled relative to one other such as not to create points of discontinuity in the profile of the curvature.

In the state of the art, the beams of adjacent formworks are joined to one another by means of bolted plates provided with holes and/or slots which allow the beams to translate and to rotate slightly relative to each other.

The correct positioning of the various beams is therefore obtained by appropriately adjusting the framework normally used to support the formworks.

One problem encountered with use of the variable curvature formworks is therefore that of assembly and correct adjustment of the frameworks supporting the formworks.

Said operations are laborious and time-consuming.

SUMMARY OF THE INVENTION

In the sector the need is therefore felt for a formwork for the production of concrete articles with a curved profile, in particular, but not exclusively, for covering tunnels and similar, which overcomes the limits of the equipment of the known art.

In particular, an object of the present invention is to propose a formwork that makes installation and adjustment of the position of the formworks easier and more practical.

Another object of the present invention is to make available a formwork that allows elimination or in any case reduction of the operations for adjustment of the framework supporting the formworks.

A further object of the present invention is to produce a formwork provided with an adjustment mechanism for adjustment of the position which is simple to produce, and is robust and inexpensive.

These and other objects are achieved by a formwork which comprises at least one structural supporting beam and at least one panel, connected to the supporting beam, curvable around a direction of curvature. In detail, said direction of curvature is transverse, and preferably perpendicular, to a main development axis of the beam.

Above, and below, the term main development axis refers to an axis oriented in the direction of the largest dimension of the beam. In particular, said axis extends between the ends of the beam and is substantially parallel to the surface of the panel in the flat or non-deformed condition.

The beam, according to the invention, can have any shape, not necessarily rectilinear, for example partly or completely curved, likewise it can have a profile with constant or variable section in terms of shape and dimensions.

The inner side of the panel can be connected to the beam in various ways, for example with a rigid fixed structure or by means of an adjustment device adapted to vary the curvature of said panel. The outer side of the panel is designed to receive the concrete casting.

According to the invention, the formwork comprises connection means which allow the beam to be connected to another structure, for example to the beam of a formwork arranged adjacent or, also, to a supporting structure adapted to support the formwork.

Said connection means are present in the area of at least one and preferably both ends of the beam.

According to the invention, said connection means comprise at least one slide connected to the beam so as to translate or rotate relative to it, or perform a combination of the above-mentioned movements.

According to a possible embodiment, the slide is slidingly connected to the beam. According to a preferred variation, the slide is movable in a direction substantially parallel to its development axis X.

Alternatively, the slide can be hinged to the beam so as to perform a simple rotation or can be connected to a mechanism which allows combined roto-translation movement.

The slide carries at least one fastening means which allows connection of the beam to the above-mentioned other structure. More preferably, the slide comprises a first fastening means, for connection of the beam to another adjacent beam, and a second fastening means, for connection of the beam to a supporting structure, for example a framework or similar.

The formwork thus produced makes the installation operations more practical and rapid since the connection to the supporting structure and with another adjacent formwork can be carried out substantially simultaneously.

Furthermore, due to the fact that said supporting structure is connected to the formwork by means of the slides, namely in the area of the lateral ends of the beam, the formwork according to said embodiment presents minimum negligible deformations in the joining area of two adjacent panels.

According to a preferred variation, the fastening means on the slide comprise holes adapted to house pins, bolts or other equivalent coupling means.

According to the invention, the connection means further comprise an adjustment mechanism which acts on the slide to vary and adjust its position relative to the beam.

The adjustment mechanism is therefore configured to move the slide in the above-mentioned direction parallel to the development axis of the beam or to rotate it or to control both movements.

By acting on the adjustment mechanism it is therefore possible to move the slide and the relative fastening means to a position such as to permit the arrangement of several adjacent formworks with the relative panels aligned along a uniform continuous curved profile.

In fact, according to the curvature of the panel, the fastening means, especially the one that connects one beam to another, must be located in a more or less extended position relative to the development axis.

For said purpose, said adjustment mechanism is configured to move and maintain the fastening means between two end positions and intermediate positions. Said end positions are, for example, a retracted position and an extended position respectively.

In this way, during set-up of the supporting structure that supports the various formworks, all that needs to be done is to arrange the various beams with a correct angular position between one another to obtain the above-mentioned uniform continuous curved profile.

According to the invention, the adjustment mechanism is configured to move the slide in a continuous manner between the retracted position and the extended position. Said configuration offers substantially infinite intermediate positions between the extended position and the retracted position.

In this way it is possible to arrange the relative fastening means in the correct position with any angle of curvature of the panel within a predetermined range for a given formwork.

According to a preferred embodiment, the adjustment mechanism comprises a threaded bar rotatably connected to the slide and to the beam, preferably around an axis substantially parallel to the development axis of the latter.

The mechanism further comprises at least one threaded insert, mounted integral on the slide or on the beam. Said threaded insert cooperates with the above-mentioned threaded bar so that when the threaded bar is rotated, in one direction or the other, the slide is moved in the sliding direction.

According to a preferred variation, the adjustment mechanism comprises a first threaded insert mounted on the slide and a second threaded insert mounted on the beam. The threaded bar, in turn, comprises two threaded portions each cooperating with a relative insert. Said threaded portions, preferably, have threads opposite each other so that at each complete rotation of the threaded bar, the slide moves by a length equal to the sum of the thread pitches of the first and the second insert.

According to another aspect of the invention, the movement of the slide between the retracted position and the extended position is limited by stroke end means. According to a preferred variation, said stroke end means comprise at least one slot, obtained in the slide, in which a respective pin integral with the beam is slidingly housed. The major axis of said slot is arranged substantially parallel to the development axis of the beam.

According to another aspect of the invention, at least in the area of the end of the beam a housing is obtained in which the slide can run. According to a preferred variation, the beam comprises two section bars arranged side by side and substantially parallel to each other between which the above-mentioned housing is comprised.

The slide preferably comprises a pair of plates facing each other, parallel to each other and rigidly coupled. According to said variation, the threaded bar and the threaded insert of the adjustment mechanism are arranged between said plates.

In the variation with rectilinear translation of the slide, the latter can be equipped with abutment means adapted to prevent them from rotating relative to the beam.

According to a preferred embodiment, said constraint means collaborate with an abutment surface of the beam.

Said constraint means also act as structural elements that transmit the forces and the loads deriving from the thrust of the concrete during production of the casting, from the beam to the slide and from the latter to the supporting structure. Said constraint means thus allow any stress to be discharged from the adjustment mechanism, permitting the actuation thereof in any condition and preserving the operation thereof.

According to a variation of the invention, said constraint means comprise brackets which extend laterally from the slide, adapted to cooperate resting on a lower surface of the beam. More precisely, said brackets extend from the outer surface of the parallel plates.

Alternatively or additionally, said constraint means can comprise a transverse element, interposed between the two plates of the slide, adapted to slide on an abutment integral with the beam, preferably obtained in the housing of the adjustment mechanism.

Again alternatively, said constraint means can comprise slots obtained in the plates of the slide in which respective pins integral with the beam are housed.

According to said variation the stroke end means and the constraint means coincide.

BRIEF DESCRIPTION OF THE DRAWINGS

Further characteristics and advantages of the present invention will become clearer from the description of a preferred but non-exclusive embodiment of a formwork as illustrated in the attached figures in which.

DESCRIPTION OF THE PREFERRED EMBODIMENTS

Figure 1:
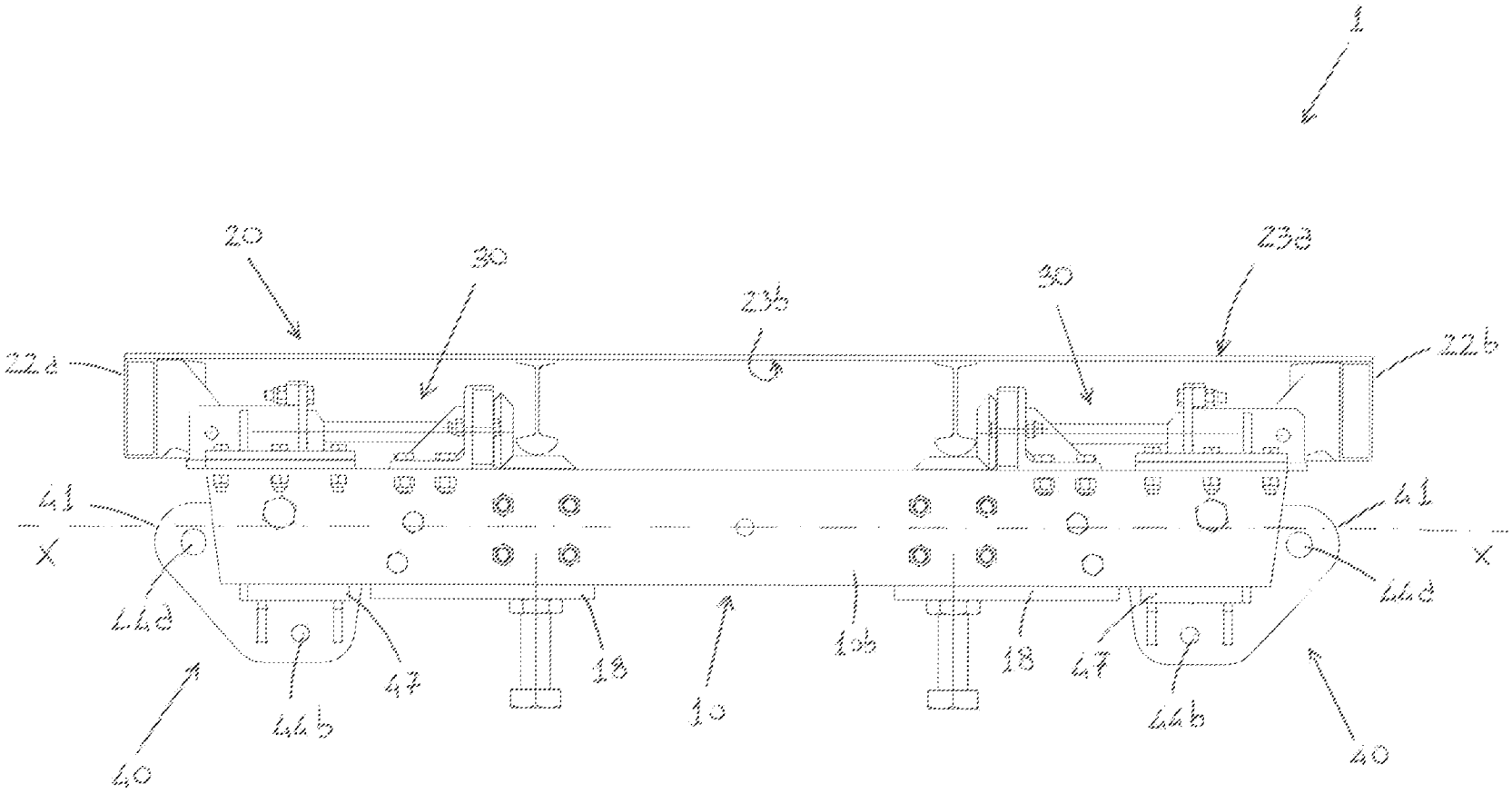
FIG. 1 is a front view of a formwork, according to a variation of the invention.
Figure 2:
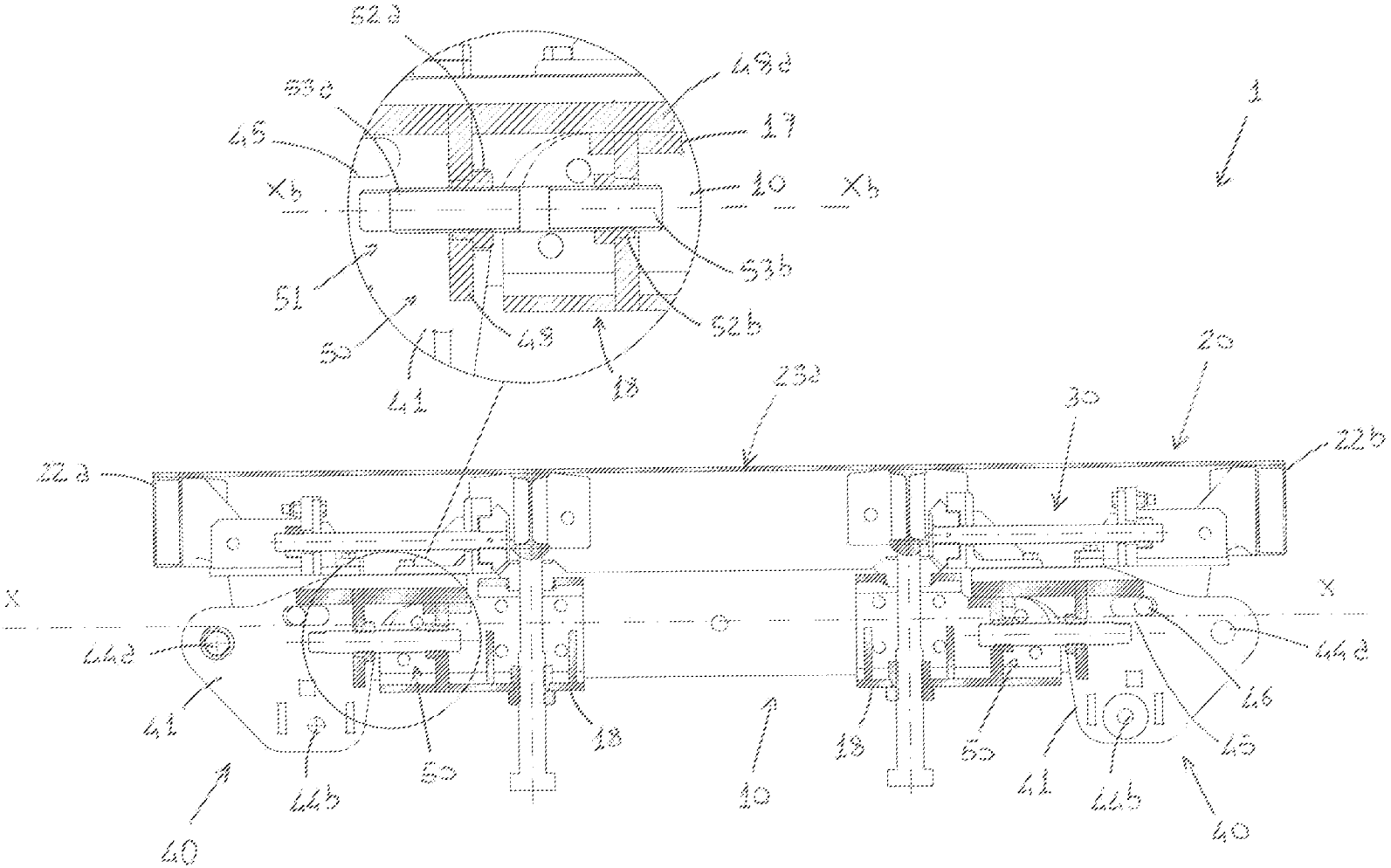
FIG. 2 is a view of the beam of the formwork of FIG. 1, sectioned along a plane parallel to the main development axis.
Figure 3:
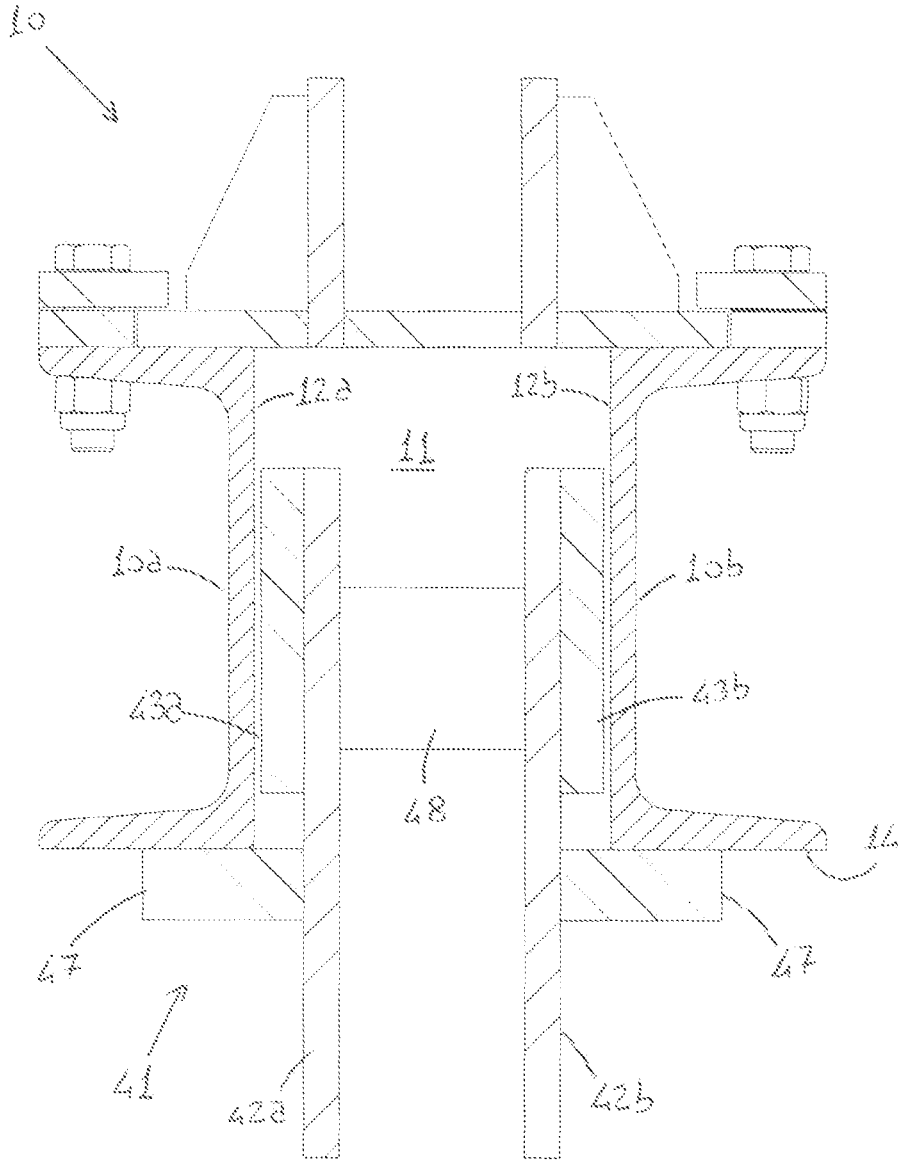
FIG. 3 is a view of the beam of the formwork of FIG. 1, sectioned along a plane transverse to the main development axis.
Figure 4A:
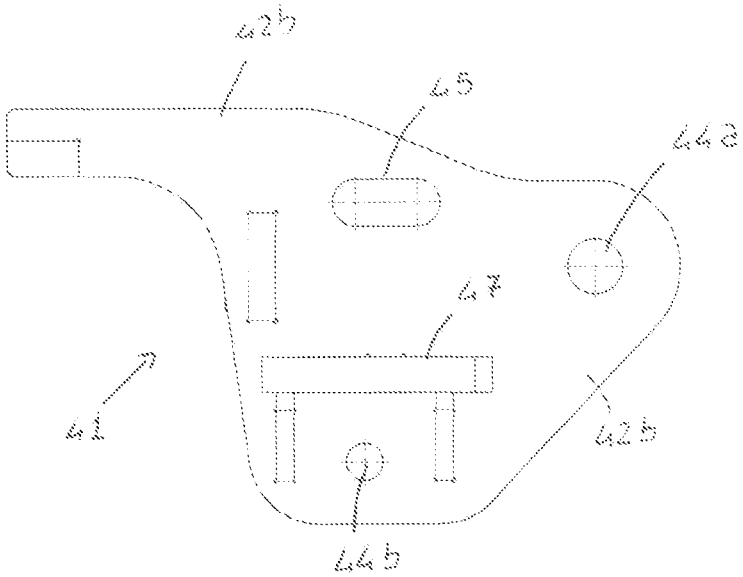
FIGS. 4*a* and 4*b* are a front view and a lateral view respectively of the slide of the formwork of FIG. 1.
Figure 4B:
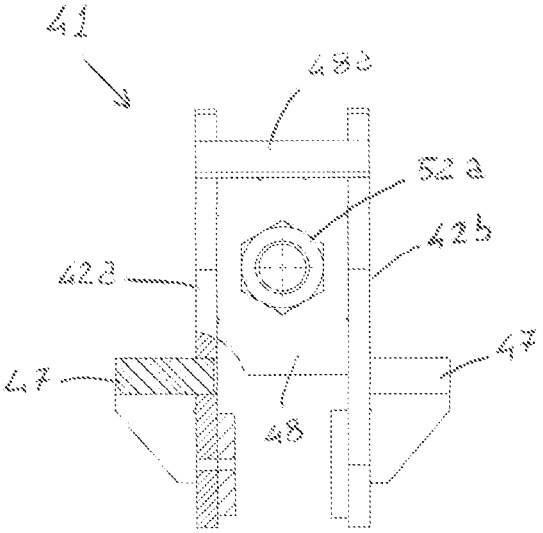

With reference to the attached figures, the number 1 indicates overall a formwork for the production of concrete articles, or equivalent construction materials, which have at least one curved surface.

The formwork 1 comprises at least a supporting beam 10 and at least a panel 20 which defines the "shell" adapted to give the curved shape to said surface of the article.

According to a preferred variation illustrated in the example of the figures, the beam 10 comprises a pair of rectilinear section bars 10*a*, 10*b* which develop along a main axis X.

For example, the beam can have a coupled double UPN profile, or other forms commonly used in engineering and construction. In this way it is possible to use catalogue-ordered materials supplied by the majority of suppliers, limiting production costs.

However, the beam can have any shape, for example partly or wholly arched or with one or more curved sides. In this case the development axis X is positioned in the direction of the largest dimension of the beam and is parallel to the panel 20, when the latter is flat.

The beam 10 is preferably made of metal or other materials suited to withstanding the stress transmitted by the concrete casting to the panel. According to the arrangement of the formwork during use, said stress originates from the hydrostatic thrust of the casting or, in the case of the production of vaults of tunnels and the like, also from its weight.

The panel 20 comprises a flat sheet having a different thickness depending on the component material. Typically, the panel is made of metal, for example steel, but can equally be made of wood or laminated plastic materials. Said thickness, in any case, is such as to allow the panel to be bent without being damaged and at the same time withstand the pressure exerted by the casting without being deformed.

The panel 20 typically has a rectangular or square shape with a front edge 21 and a rear edge, not visible in the figure, parallel to the axis X of the beam 10 and two lateral edges 22*a*, 22*b* substantially perpendicular to said axis X.

The dimensions of the panel 20 are variable according to requirements. Generally, the panel has a width, in the direction X, ranging from 0.3 metres to 3 metres, and a length ranging from 0.5 metres to 6 metres.

According to the length of the panel 20, the formwork 1 can comprise one single beam 10, for example in the centre of the panel lengthwise, two beams 10, in the area of the front and rear edges of the panel respectively, or further beams 10 arranged between said front and rear edges.

The panel 20 is connected to the beam 10 in the area of an inner surface 23*b*, the one facing downwards in the attached figures. The outer surface 23*a*, on the other hand, is designed to come into contact with the concrete casting.

In the example in the figures, the panel 20 is connected to the beam 10 by means of an adjustment device, indicated overall by the number 30, which allows both variation of the curvature of said panel 20 around a direction Y transverse relative to the axis X of the beam 10, and transfer to said beam of the forces discharged by the casting. The beam according to the invention can, however, be provided with adjustment devices different from the one illustrated and of known type. The adjustment device will therefore not be described in further detail.

According to the invention, the formwork is equipped with connection means, indicated overall by the number 40, positioned in the area of at least one of its ends, or preferably of both, as in the example of the figures.

Said connection means comprise a slide 41 running in a direction parallel to the axis X of the beam 10 between a retracted position, in which it is at a minimum distance from the centre line of the beam 10, and an extended position, in which it is at a minimum distance from the above-mentioned centre line of the beam 10.

In further detail, said slide 41 is arranged in the space between the two section bars 10*a*, 10*b* of the beam 10, which defines a housing 11.

According to a preferred variation, the slide 41 comprises two plates 42*a*, 42*b* facing each other and rigidly coupled by means of one or more spacers 48 adapted to maintain them substantially parallel at a given distance.

The width dimension of the slide 41 is calculated according to the width of the housing 11, namely the distance between the two section bars 10*a*, 10*b* of the beam 10. In particular, the two plates 42*a*, 42*b* are arranged at a distance such that the respective outer surfaces 43*a*, 43*b* are substantially in contact with the respective inner sides 12*a*, 12*b* of said section bars.

The slide 40 is equipped with fastening means 44*a*, 44*b* which allow connection of the beam to other structures. In the example of the figures, said fastening means comprise holes, or slots, adapted to house pins, bolts and the like.

In further detail, the slide 41 comprises a first hole 44*a* for connection of the beam 10 to an adjacent beam, for example to another slide 41 of an identical beam 10. The slide 41 further comprises a second hole 44*b* to which a supporting structure 100 can be connected, adapted to support the various formworks such as, for example, the equipment illustrated in FIG. 5. In the variation illustrated, said holes 44*a*, 44*b* cross both the plates 42*a*, 42*b*.

The movement of the slide 41 relative to the beam 10 is limited by stroke end means and by constraint means.

The stroke end means comprise a slot 45 obtained on at least one and preferably on both the plates 42*a*, 42*b*. The slot 45 is arranged with its major axis substantially parallel to the development axis X of the beam 10.

The slot 45 houses a pin 46 mounted integral on the beam 10. The length of the major axis of the slot 45 coincides substantially with the stroke which the slide can perform along the axis X between the retracted position and the extended position.

The slot 45 and the pin 46, in addition to the above-mentioned stroke end function, also have a structural function since through the pin 46 a part of the loads on the beam 10 are transmitted to the slide 41.

The constraint means comprise a pair of brackets 47, projecting laterally from the slide 41, on which the lower side 14 of the beam 10 rests, and more precisely of the respective section bars 10*a*, 10*b*.

Said brackets 47 have the job of constraining rotation of the slide 41 relative to the beam 10 and the task of transmitting to said slide the stress which the beam 10 receives from the panel 20.

Preferably, the constraint means further comprise a transverse element 48*a* interposed between the plates 42*a*, 42*b* which slides in contact with an abutment element 19 integral with the beam 10.

Preferably said abutment element 19 is obtained in a housing 18 which also houses part of the adjustment system described below.

The element 48*a* also acts as a spacer for the plates 42*a*, 42*b*.

According to the invention, adjustment of the position of the fastening means, and therefore movement of the slide 41, is carried out by means of an adjustment mechanism indicated overall by the number 50.

According to a preferred variation, the adjustment mechanism comprises a threaded bar 51 mounted in a rotating manner relative to the beam and housed between the inner walls of the two section bars 10*a*, 10*b* of the beam 10. The threaded bar 51 is arranged with its rotation axis Xb substantially parallel to the development axis X of the beam.

Said threaded bar 51 comprises two threaded portions 53*a*, 53*b*, respectively screw-tightened in a first insert 52*a* integral with the slide 41 and with second insert 52*b* integral with the beam 10. The first insert 52*a* is preferably arranged between the plates 42*a*, 42*b* of the slide 41. The second insert 52*b* is preferably housed between the section bars 10*a*, 10*b* of the beam 10. Preferably said second insert 52*b* is mounted in the housing 18 of the beam 10.

Rotation of the threaded portions of the bar in the respective inserts causes movement of the slide 41 along the axis X. The rotation of the threaded bar 51 can be imparted by using an appropriate tool on a head 54 positioned at one of the ends.

The screw adjustment mechanism thus conceived allows the slide 41 to be arranged and maintained in any intermediate position between the extreme retracted and extended positions.

Figure 5:
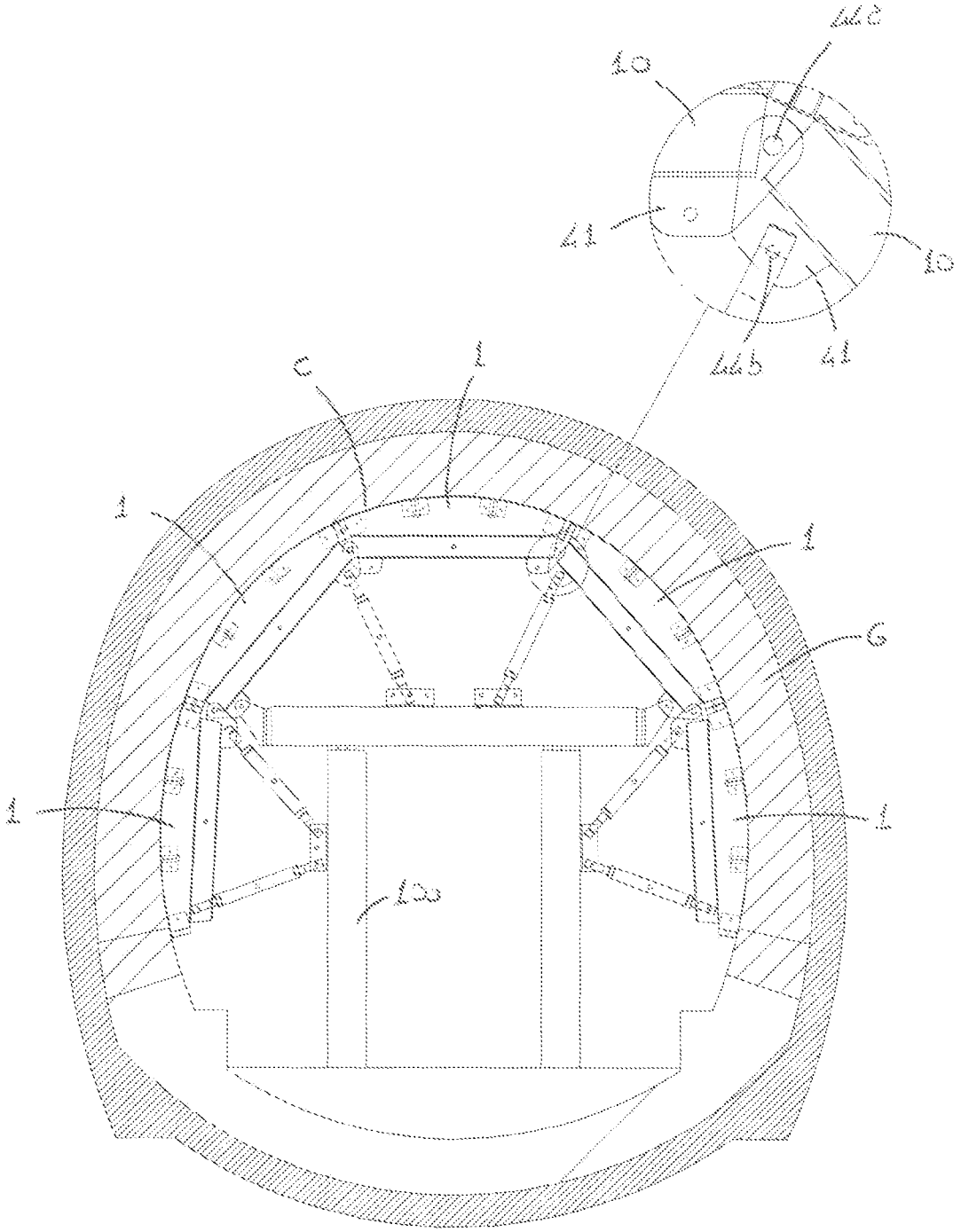
FIG. 5 is a front view of equipment comprising formworks according to the invention, arranged in a tunnel.

Due to said adjustment it is possible to place the holes 44*a* of the fastening means at a distance that allows, by joining several formworks 1 to one another, the respective panels 20 to be positioned so that the outer surfaces 23*a* form a curved, continuous and uniform profile, as shown in FIG. 5.

Said distance can be easily obtained by means of calculations once the curvature of the profile and the dimensions of the formwork are known.

According to a possible variation, the formwork can be provided with appropriate markers adapted to indicate the distance of the holes 44*a*, 44*b* of the fastening means from a fixed reference on the beam, for example the centre line or other.

Adjustment of the position of the slides 41 can be made either with the formworks 1 dismantled and on the ground or when they are already installed on the equipment 100, for example to perform final precision adjustments.

In the example of FIG. 5, the formworks 1 are mounted on equipment 100 and arranged side by side to create a curved surface C of a vault of a tunnel G.

Due to the present invention it is therefore possible to arrange and connect to one another the various formworks more quickly and simply than in the case of the formworks of the known art. In fact, during use of the formwork, the slides are always blocked in rotation and translation by the adjustment mechanism. In this way, in the area of the connection point between two adjacent beams, even only one supporting element of the equipment 100 is sufficient.

The adjustment system thus produced is furthermore simple and reliable in addition to being inexpensive to produce.

The invention has been described for illustrative non-limiting purposes, according to some preferred embodiments. A person skilled in the art will be able to find numerous other embodiments and variations, all falling within the protective scope of the following claims.

The invention claimed is:

1. A formwork (1) for the production of concrete articles comprising:

at least one supporting beam (10) with a development axis (X);

at least one panel (20) which has an outer surface (23*a*) designed to be in contact with a concrete casting, said panel (20) being connected from an inner side (23*b*) to the beam and being curvable around a transverse direction (Y) relative to the development axis (X) of said beam;

connection means (40), present in the area of at least one end of said beam, adapted to allow connection of the beam (10) to another structure;

wherein said connection means (40) comprise:

at least one slide (41) connected to the beam (10) so as to perform a translation or rotation movement, or both, said slide (41) carrying a first fastening means (44*a*), to connect the beam (10) to another adjacent beam, and a second fastening means (44*b*), to connect said beam (10) to a supporting structure;

an adjustment mechanism (50) which acts on the slide (41) to move it continuously between a retracted position and an extended position, adjusting its position relative to the beam.

2. The formwork (1) according to claim 1, wherein said slide (41) is slidingly connected to the beam (10) and is movable in a direction substantially parallel to the development direction (X) of the beam.

3. The formwork (1) according to claim 2, wherein said adjustment mechanism (50) comprises a threaded bar (51) connected to the slide (41) and to the beam (10) and rotatingly mounted around an axis (Xb) substantially parallel to the development axis (X), said threaded bar (51) cooperating with at least one threaded insert (52*a*, 52*b*), integral with the slide (41) or with the beam (10), so that the rotation of said threaded bar (51) causes movement of the slide (41).

4. The formwork (1) according to claim 2, wherein at least in the area of one end of the beam (10) a housing (11) is obtained inside which said slide (41) can run.

5. The formwork (1) according to claim 2, wherein said slide (41) comprises constraint means (47, 48*a*) adapted to cooperate with an abutment (14, 19) of the beam.

6. The formwork (1) according to claim 1, wherein said adjustment mechanism (50) comprises a threaded bar (51) connected to the slide (41) and to the beam (10) and rotatingly mounted around an axis (Xb) substantially parallel to the development axis (X), said threaded bar (51) cooperating with at least one threaded insert (52*a*, 52*b*), integral with the slide (41) or with the beam (10), so that the rotation of said threaded bar (51) causes movement of the slide (41).

7. The formwork (1) according to claim 6, wherein said slide (41) comprises a pair of facing plates (42*a*, 42*b*) parallel to each other and rigidly coupled.

8. The formwork (1) according to claim 7, wherein said threaded insert (52*a*) is arranged between said plates (42*a*, 4*ab*).

9. The formwork (1) according to claim 6, wherein at least in the area of one end of the beam (10) a housing (11) is obtained inside which said slide (41) can run.

10. The formwork (1) according to claim 6, wherein said slide (41) comprises constraint means (47, 48*a*) adapted to cooperate with an abutment (14, 19) of the beam.

11. The formwork (1) according to claim 1, wherein at least in the area of one end of the beam (10) a housing (11) is obtained inside which said slide (41) can run.

12. The formwork (1) according to claim 11, wherein the beam (10) comprises two section bars (10*a*, 10*b*) arranged side by side and substantially parallel to each other between which the said housing (11) is comprised.

13. The formwork (1) according to claim 12, wherein said slide (41) comprises constraint means (47, 48*a*) adapted to cooperate with an abutment (14, 19) of the beam.

14. The formwork (1) according to claim 11, wherein said slide (41) comprises constraint means (47, 48*a*) adapted to cooperate with an abutment (14, 19) of the beam.

15. The formwork (1) according to claim 1, wherein said slide (41) comprises constraint means (47, 48*a*) adapted to cooperate with an abutment (14, 19) of the beam.

16. The formwork (1) according to claim 15, wherein said constraint means comprise brackets (47) which extend laterally from the slide (41), adapted to cooperate resting on a lower surface (14) of the beam.

17. The formwork (1) according to claim 15, wherein said slide (41) comprises a pair of facing plates (42*a*, 42*b*) parallel to each other and rigidly coupled; and wherein said constraint means comprise a transverse element (48), interposed between the two plates (42*a*, 42*b*), adapted to slide on an abutment (19) integral with the beam (10) and obtained in a housing of the adjustment mechanism (50).

18. The formwork (1) according to claim 1, wherein the first and second fastening means on the slide (41) comprise holes (44*a*, 44*b*) adapted to house pins or bolts.

19. The formwork (1) according to claim 1, further comprising stroke end means (45) adapted to limit the movement of the slide (41) between the retracted position and the extended position.

20. The formwork (1) according to claim 19, wherein said stroke end means comprise at least one slot (45) obtained in the slide (41), which slidingly houses a respective pin (46) integral with the beam (10), the major axis of said slot (45) being arranged substantially parallel to the development axis (X) of the beam (10).

* * * * *